US012402706B1

(12) United States Patent
Potter

(10) Patent No.: US 12,402,706 B1
(45) Date of Patent: Sep. 2, 2025

(54) HANDHELD HAIR PRODUCT DISPENSER

(71) Applicant: Alanna Potter, Los Angeles, CA (US)

(72) Inventor: Alanna Potter, Los Angeles, CA (US)

( * ) Notice: Subject to any disclaimer, the term of this patent is extended or adjusted under 35 U.S.C. 154(b) by 81 days.

(21) Appl. No.: 18/368,238

(22) Filed: Sep. 14, 2023

(51) Int. Cl.
*A45D 24/28* (2006.01)
*A45D 34/04* (2006.01)
*A46B 11/00* (2006.01)
*A46D 1/00* (2006.01)

(52) U.S. Cl.
CPC ..... *A45D 24/28* (2013.01); *A45D 34/042* (2013.01); *A46B 11/0006* (2013.01); *A46D 1/0246* (2013.01); *A45D 2200/05* (2013.01); *A45D 2200/055* (2013.01); *A46B 2200/104* (2013.01)

(58) Field of Classification Search
CPC ..... A45D 24/28; A45D 24/26; A45D 24/22; A45D 19/026; A46B 11/0031; A46B 11/0034; A46B 11/0027; A46B 11/0055; A46B 11/0051
USPC ..... 132/114, 115
See application file for complete search history.

(56) References Cited

U.S. PATENT DOCUMENTS 933,274 A * 9/1909 Swanberg ..... A45D 24/22 132/114
2,565,889 A * 8/1951 Schroer ..... A45D 24/24 604/289
4,617,875 A * 10/1986 Holland ..... A01K 13/003 401/281
5,343,880 A * 9/1994 McKay ..... A45D 19/026 132/115
6,022,163 A * 2/2000 Asfur ..... A45D 24/22 401/268
6,145,513 A * 11/2000 Chu ..... A45D 19/026 401/268
6,302,607 B1 * 10/2001 Burrowes ..... A45D 34/04 401/23
6,457,476 B1 * 10/2002 Elmer ..... A45D 24/22 132/901
6,752,157 B2 * 6/2004 Lu Shao Hua ..... A45D 24/22 132/109
7,350,524 B2 * 4/2008 Kimura ..... B65D 35/36 132/114
8,118,036 B2 * 2/2012 Wang ..... A45D 24/26 132/112
9,247,805 B1 * 2/2016 Malm ..... A46B 11/0079
2006/0021628 A1 * 2/2006 Mu ..... A45D 19/026 132/114
2007/0157942 A1 * 7/2007 Adkins ..... A46B 9/023 132/112
2009/0028629 A1 * 1/2009 deVirag ..... B65D 83/0011 401/266

* cited by examiner

*Primary Examiner* — Tatiana L Nobrega

(57) ABSTRACT

A dispensing brush and/or comb assembly is made to contain and selectively dispense a fluid. The assembly includes a brush and/or comb having an internal cavity for accepting a fluid, hollow bristles, and a body couplable to the brush and/or comb, having an internal space for receiving a fluid container. The fluid container is removably placed within the internal space of the body and is fluidly connected to the brush and/or comb internal cavity in an installed position, and a cover for retaining the fluid container within the body.

13 Claims, 3 Drawing Sheets

HANDHELD HAIR PRODUCT DISPENSER

BACKGROUND

Technological Field

The disclosure relates to a brush for comb device having a selectively dispensing a hair care product, and more specifically the brush or comb device having a removable dispensing container allowing the user to replace or refill the dispensing unit when it is empty, or to dispense a different product altogether.

Description of Related Art

Innumerable variations of combs, hairbrushes, and the like have been developed in the past. Many such devices have been developed for some specific purpose, i.e., to solve some problem in the field of grooming and hair care. While routine, day-to-day hair care, i.e., combing and brushing, is generally a single step process requiring the use of only a single tool or device (comb, brush, etc.), the need or desire for more involved hair treatment may require several steps.

An example for treatment is the process of minimal dying for grays, streaks of coloring for the hair, and putting other products in, like hair relaxers and edge control to tame hairline flyaways. Many people wish to change the color of their hair, perhaps as a change of pace, or to go with a new wardrobe, a change of the season, or for a special occasion. While other brushes developed in the past have been used for one particular purpose, the present disclosure allows a user to change between products and product types that are used by the brush.

SUMMARY

A dispensing brush and/or comb assembly meant to contain and selectively dispense a fluid is disclosed. The assembly includes a brush and/or comb having an internal cavity for accepting a fluid, a body couplable to the brush and/or comb, having an internal space for receiving a fluid container. The fluid container is removably placed within the internal space of the body and is fluidly connected to the brush and/or comb internal cavity in an installed position. The assembly can include a charging stand having a cavity for accepting a portion of the body.

The fluid container can be coupled to the brush and/or comb by a valve located within the body.

The fluid container can include a main section and a narrowed section for connecting to the valve.

The body can include a switch to activate a piston configured to force the fluid from the fluid container into the internal cavity of the brush and/or comb. The switch can be battery powered. The piston can be coupled to a threaded rod. The threaded rod can extend through the length of the fluid container. The piston can be actuated by a DC motor.

The brush and/or comb can include a plurality of bristles wherein each of the bristles of the plurality of bristles are parallel to each other. The brush and/or comb can be lockably coupled with the body. The body can extend along the length of the brush and/or comb.

The bristles do not extend past an outer surface of the body. A cover can be removably coupled to the body over the brush and/or comb. The brush and/or comb can include at least one dispensing nozzle. The valve can include a plurality of holes on a first side emanating perpendicular to the longitudinal axis of the valve configured to mate with the at least one dispensing nozzle.

The brush and/or comb can be configured to turn the assembly "on" in a first position and to turn the assembly "off" in a second position. The brush and/or comb can be rotatable between the first position and the second position In the second position an outlet of the valve can face away from a dispensing nozzle of the brush and/or comb. The body can include an undulating outer surface.

These and other features of the systems and methods of the subject disclosure will become more readily apparent to those skilled in the art from the following detailed description of the preferred embodiments taken in conjunction with the drawings.

FIGURES DESCRIPTION

The disclosure will be better understood and objects other than those set forth above will become apparent when consideration is given to the following detailed description thereof. Such description makes reference to the annexed drawings wherein.

DETAILED DESCRIPTION

Figure 1:
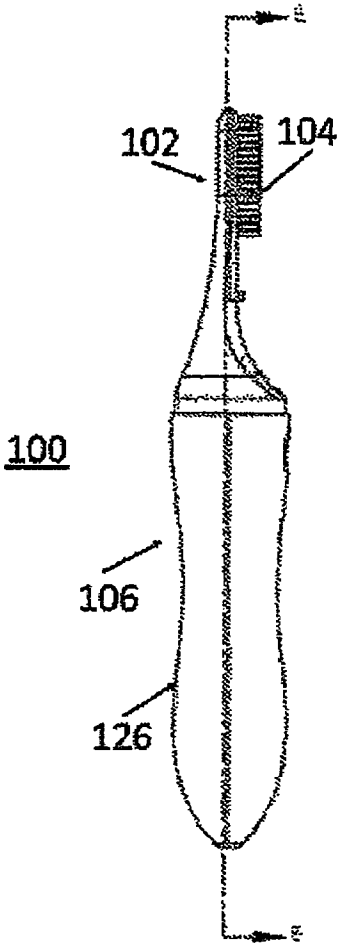
FIG. 1 is a side view of a dispensing brush and/or comb assembly according to an embodiment of the disclosure.

Reference will now be made to the drawings wherein like reference numerals identify similar structural features or aspects of the subject disclosure. For purposes of explanation and illustration, and not limitation, a partial view of an exemplary embodiment of a hair product dispensing brush and/or comb assembly in accordance with the invention is shown in FIG. 1 and is designated generally by reference character 100. Other embodiments of the assembly in accordance with the invention, or aspects thereof, are provided in FIGS. 2-6, as will be described. The methods and systems of the invention can be used to use various dyes and hair products interchangeably in the same brush and/or comb or applicator.

FIG. 1 shows a dispensing brush and/or comb assembly 100 that contains and selectively dispenses a fluid as needed. The assembly 100 includes a brush and/or comb applicator 102. The brush and/or comb applicator 102 includes an internal cavity and hollow bristles 104 (shown in FIG. 2) through which the fluid travels. The assembly 100 includes a body 106 which couples to the brush and/or comb applicator 102. The body 106 has a handle portion and a head portion extending longitudinally from a distal end of the handle portion. The head portion has a proximal portion which tapers gradually inwardly toward the longitudinal axis (shown in FIGS. 1 and 5) and a distal portion to which the brush and/or comb applicator is detachably coupled. The handle portion has a rear half-shell and a front half-shell/front cover 132, where the rear half-shell and front half-shell define an internal space 108 (shown in FIG. 2) which receives and houses the fluid container 110 while the assembly 100 is in use. The fluid container 110 is removably placed within the internal space 108 of the body and is fluidly connected to the brush and/or comb internal cavity and hollow bristles 104 in an installed position.

Figure 2:
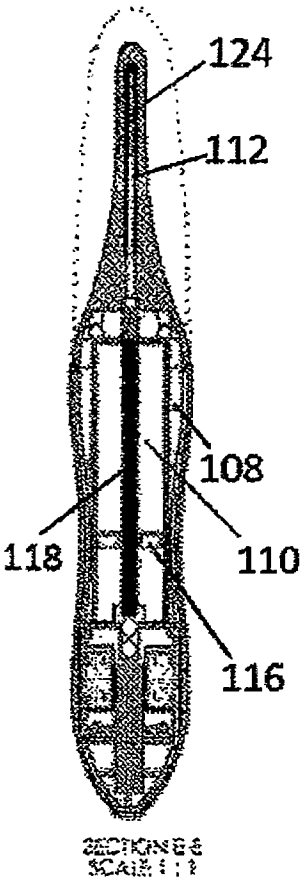
FIG. 2 is a sectional view of FIG. 1.
Figure 3:
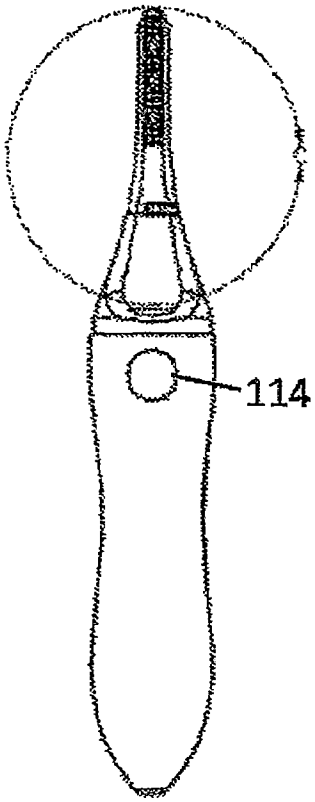
FIG. 3 is a front view of FIG. 1.

FIG. 2 shows an inner working of the assembly 100. The fluid container 110 is coupled to the brush and/or comb 102 by a valve 112. The fluid container 110 includes a main section 110*a* and a narrowed section 110*b* for connecting to the valve 112. FIG. 3 shows a switch 114 which is used to activate a piston 116 which drives through and decreases the inner volume of the fluid container 110 and forces the fluid from the fluid container 110 into the brush and/or comb applicator 102. The switch or button 114 and piston 116 are shown being battery powered, but one will readily understand that other powering mechanisms and systems can be employed. The piston 116 is coupled to and actuated by a turning threaded rod 118. A user depresses dispensing button 114 momentarily to dispense a set amount of liquid or gel. The user could also hold down the dispensing button 114 to continuously dispense liquid or gel. After depressing dispensing button 114 or while holding button the user can then apply brush and/or comb and dispense liquid or gel to their hair. The threaded rod 118 extends the length of the fluid container 110. The piston 116 can be actuated by a DC motor or any other acceptable means. When the device has depleted the dispensing container 110, the dispensing mechanism will stop and the device will notify the user via the light and/or sound.

When the device has dispensed all of the liquid or gel in the dispensing container 100 the user can replace the container 110 by removing a front half-shell/cover 132. The old dispensing container can be removed and a new one inserted. The dispensing cover 132 is then replaced/reconnected.

Figure 4:
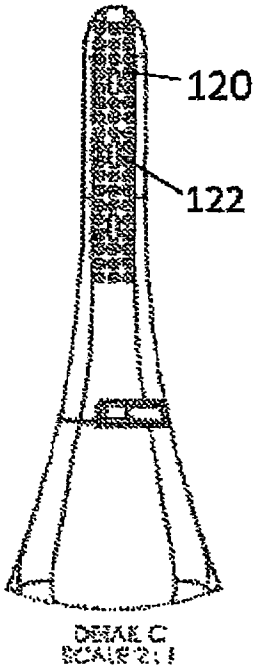
FIG. 4 is an enlarged view of section C of FIG. 3.
Figure 5:
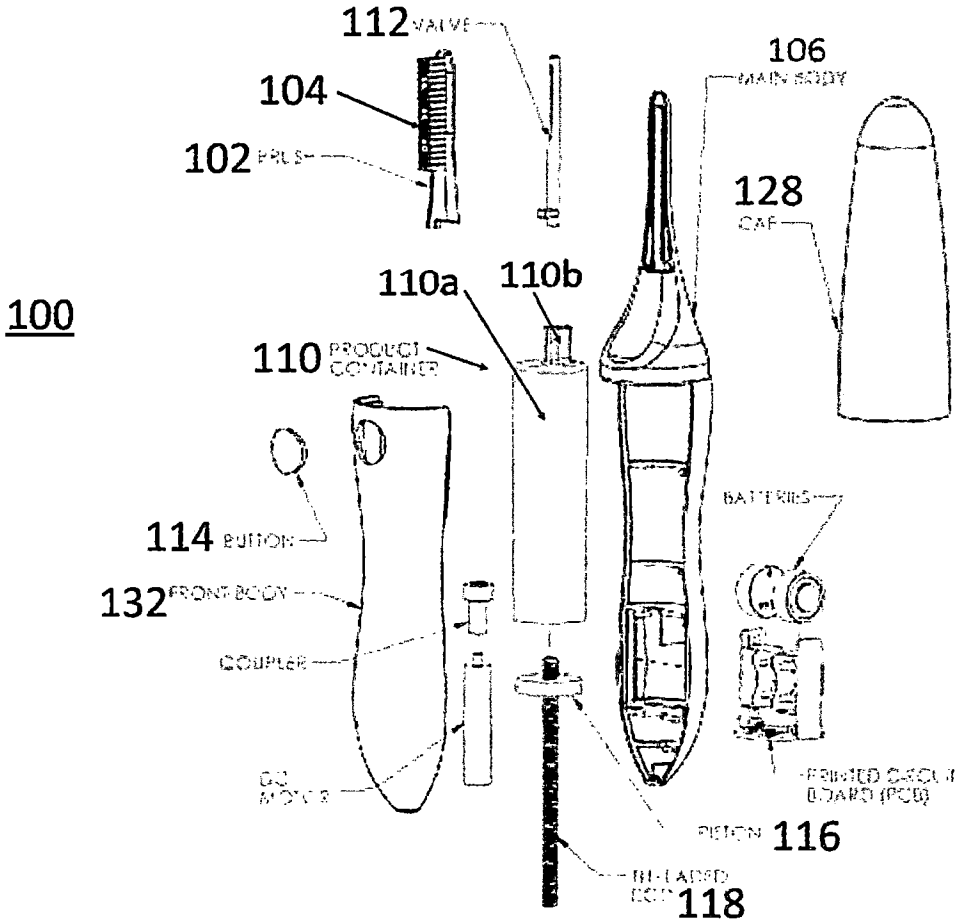
FIG. 5 is an exploded view of FIG. 1.

FIG. 4 shows a close up of the brush and/or comb applicator 102. The brush and/or comb applicator 102 includes a plurality of bristles 120. The bristles 120 are aligned parallel to each other and point in the same direction. The brush and/or comb applicator 102 includes several dispensing nozzles 122 which are used for placing the fluid on the user's head. The valve 112 includes a plurality of holes 124 (shown in FIG. 2) on a front side thereof, emanating perpendicular to the longitudinal axis of the valve 112 which mates with the dispensing nozzle 122, and as the fluid travels up the valve 112 from the fluid container 110, the fluid enters the brush and/or comb bristle nozzles 122.

The brush and/or comb applicator 102 is lockably coupled with the body 106. The body 106 extends all the way along the length of the brush and/or comb applicator 102, in order to provide support and locking capabilities to the brush and/or comb applicator 102. The bristles do not extend past an outer surface 126 of the body 106, which allows a cover 128 to be placed over the brush and/or comb when not in use to prevent leaks from oozing out. The brush and/or comb applicator 102 is also used to turn the assembly "on" in a first position and to turn the assembly "off" in a second position. The brush and/or comb applicator 102 is rotatable between the first position and the second position. In the first position, the dispensing nozzle 122 and outlet(s) of the valve 112 are arranged to dispense the fluid from a front side of the assembly (fluid is not dispensed from a rear surface of the distal portion of the head). In the second position an outlet of the valve 112 faces away from the dispensing nozzle 122 of the brush and/or comb applicator.

Figure 6:
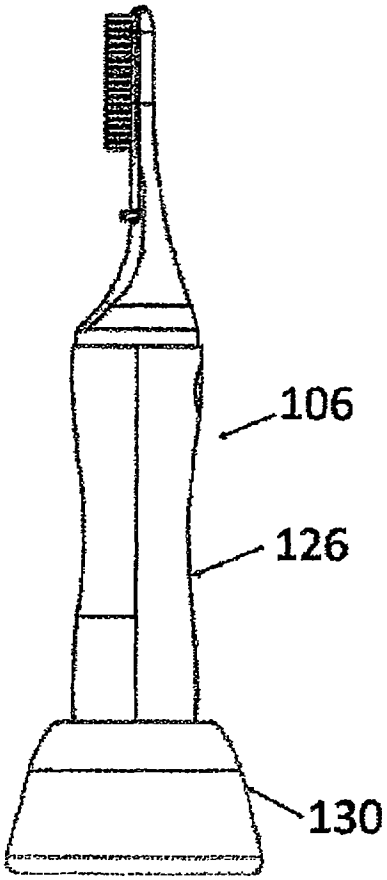
FIG. 6 is a side view of the assembly of FIG. 1 in a charging stand.

As can be seen in FIG. 6, the handle portion of the body 106 has an undulating outer surface 126 for better grip. The assembly 100 can include a charging stand 130 which has a cavity for accepting a portion of the body in order to charge is using a USB, or other type of plug. When the device runs low on battery, a light and/or sound will alert the user to the low battery status. The user can then charge the device by placing it into the base station 130. The light and/or sound will later notify the user that charging is complete. Assembly 100 may alternately contain non-replaceable batteries surrounded in copper coils, and additional copper coils in the charging stand 130, coupled to a PCB controller, to produce a faraday charge affect, between the interface of the two placed copper coils, and the concealed product device battery.

The methods and systems of the present disclosure, as described above and shown in the drawings provide for a hair product dispensing brush and/or comb with superior properties including increased reliability and ease of use. While the apparatus and methods of the subject disclosure have been showing and described with reference to embodiments, those skilled in the art will readily appreciate that changes and/or modifications may be made thereto without departing from the spirit and score of the subject disclosure.

The invention claimed is:

1. A hair product dispensing brush and/or comb assembly being configured to contain and selectively dispense a fluid onto hair, said assembly comprising:

a brush and/or comb applicator having a proximal end opposite a distal end, an internal cavity for accepting a fluid, a plurality of bristles extending from a front side of the brush and/or comb applicator, and at least one dispensing nozzle surrounded by the plurality of bristles, a body having a handle portion with a proximal end and a distal end, and a head portion extending longitudinally from the distal end of the handle portion, where a longitudinal axis of the assembly extends through the proximal and distal ends of the brush and/or comb applicator and the proximal and distal ends of the body, the head portion having a proximal portion which tapers gradually inwardly toward the longitudinal axis, and a distal portion to which the brush and/or comb applicator is detachably coupled, the handle portion having a rear half-shell and a front half-shell where the rear half-shell and the front half-shell define an internal space a fluid container removably placed within the internal space of the handle portion of the body and is fluidly connected to the internal cavity of the brush and/or comb applicator in an installed position, where the fluid container includes a main section and a narrowed section, and a valve coupled to the narrowed section of the fluid container and extending longitudinally within the head portion of the body, the valve including a plurality of outlets on a front side thereof emanating perpendicular to the longitudinal axis of the valve and configured to mate with the at least one dispensing nozzle, wherein the bristles of the plurality of bristles and an entirety of the head portion do not extend past an outer surface of the handle portion of the body, wherein the brush and/or comb applicator is rotatable between a first position and a second position, wherein the first position the plurality of outlets of the valve face the at least one dispensing nozzle for permitting dispensing and in the second position the plurality of outlets of the valve face away from the at least one dispensing nozzle and wherein fluid is not dispensed from a rear surface of the distal portion of the head.

2. The hair product dispensing brush and/or comb assembly of claim 1, wherein the fluid container is coupled to the brush and/or comb by the valve.

3. The hair product dispensing brush and/or comb assembly of claim 1, further comprising a piston within the fluid container, wherein the body includes a switch to activate the piston to force fluid from the fluid container into the internal cavity of the brush and/or comb applicator.

4. The hair product dispensing brush and/or comb assembly of claim 3, wherein the switch is battery powered.

5. The hair product dispensing brush and/or comb assembly of claim 3, wherein the piston is coupled to a threaded rod.

6. The hair product dispensing brush and/or comb of the assembly of claim 5, wherein the threaded rod extends through the length of the main section of the fluid container.

7. The hair product dispensing brush and/or comb of the assembly of claim 5, wherein the piston is actuated by a DC motor.

8. The hair product dispensing brush and/or comb assembly of claim 1, wherein each of the bristles of the plurality of bristles are parallel to each other.

9. The hair product dispensing brush and/or comb assembly of claim 1, wherein the body extends along the length of the brush and/or comb applicator.

10. The hair product dispensing brush and/or comb assembly of claim 1, further comprising a charging stand having a cavity for accepting a portion of the body.

11. The hair product dispensing brush and/or comb assembly of claim 1, wherein a cover is removably coupled to the body over the brush and/or comb applicator.

12. The hair product dispensing brush and/or comb assembly of claim 1, wherein the body includes an undulating outer surface.

13. The hair product dispensing brush and/or comb assembly of claim 1, wherein the front body of the handle portion is detachably coupled to the rear body of the handle portion.

* * * * *